US005886722A

United States Patent [19]

Kuehnle

[11] Patent Number: 5,886,722

[45] Date of Patent: Mar. 23, 1999

[54] MICROCHANNEL MARKING ENGINE

[76] Inventor: Manfred R. Kuehnle, P.O. Box 1020 Waldesruh, New London, N.H. 03257

[21] Appl. No.: 751,019

[22] Filed: Nov. 14, 1996

[51] Int. Cl.[6] ..... B41J 2/01; B41J 2/06

[52] U.S. Cl. ..... 347/104; 347/55

[58] Field of Search ..... 347/54, 101, 104, 347/105, 55

[56] References Cited

U.S. PATENT DOCUMENTS

| | | | |
|---|---|---|---|
| 4,166,277 | 8/1979 | Cielo et al. | 347/55 |
| 4,205,320 | 5/1980 | Fujii | 347/55 |
| 4,447,817 | 5/1984 | Naramore | 347/104 |
| 4,694,303 | 9/1987 | Morino et al. | 347/55 |
| 4,975,718 | 12/1990 | Akami et al. | 347/55 |
| 5,216,442 | 6/1993 | Parks et al. | 347/104 |
| 5,369,424 | 11/1994 | Hori et al. | 347/104 |

*Primary Examiner*—Peter S. Wong
*Assistant Examiner*—K. Shin
*Attorney, Agent, or Firm*—Cesari & McKenna, LLP

[57] ABSTRACT

A printing apparatus (10) employs electrostatic gripper plates (12, 14, and 16) to stepwise advance printing substrates (18) in a reciprocating shuttle fashion past a print head (22) that contains microchannels (33) that are filled with ink by capillary action awaiting, in concave shape at each microchannel orifice, print activation which is accomplished by imposing electrical fields at each electronically addressable orifice to cause the ink to protrude in a convex shape. To cause the paper to be marked, certain orifices are activated in accordance with imagewise information that is stored digitally in a memory which feeds data for the print head to cause the ink to protrude in varying thickness dimensions from the addressed orifices in proportion to the imposed field intensities with said protruding ink positions being transferred to the printing substrate surface in step by step fashion as the substrate advances and is between each step brought momentarily in contact with the print head orifices and then withdrawn therefrom, said ink being preferably of the hot-melted type so as to accomplish instantaneous fusion of the ink when it touches the printing substrate surface and solidifies thereon, thereby causing the formation of a novel lenticular image topography.

35 Claims, 11 Drawing Sheets

MICROCHANNEL MARKING ENGINE

BACKGROUND OF THE INVENTION

The present invention concerns printing. Its operating principles have particular, although not exclusive, applicability to portable color printers.

The printing art, which began in 1300 A.D., is quite mature. Vast amounts of research and expense have been dedicated to optimizing the quality and minimizing the cost of printing machines, particularly those intended for the consumer market. Given the difficulty of meeting the demands of the human eye, the results of these efforts have been largely satisfactory. Still, the techniques employed to achieve good enough results have tended to be complicated and expensive.

Printing devices early employed for office use to meet small-computer output needs employed hammers and print-stylus matrices. These were noisy and slow and produced low-quality output. Quality improved with the use of thermal printers, but these required special paper and tended to be slow, too. A greater quality advance accompanied the advent of xerographic or special-paper laser printers, but their mechanisms are complicated, and they remain relatively expensive despite the high volumes in which they have been produced. And none of these technologies lends itself well to low-cost-per-page, high-quality color imaging.

Ink-jet and ink-bubble technologies have addressed these shortcomings to a significant extent. Ink-jet printers squirt charged ink at the paper, deflecting the ink droplets electrostatically to direct it to the desired impact location. This approach is simple in comparison with say, laser printers, and it lends itself to color printing, since successive jets of different-colored ink can be applied to the same locations. Ink-bubble-jet approaches are similarly direct: they employ explosive energy to propel ink drops to the paper from an array of sources. But the ballistic nature of the ink delivery to the paper or other print substrate in both of these approaches tends to make the image quality quite dependent on the type of paper or other image medium.

SUMMARY OF THE INVENTION

Despite the apparent simplicity of a ink-jet and ink-bubble approaches, I have device a way of printing in a manner that is even simpler and lends itself to embodiment in printers that are very slim as well as more robust, faster, and less expensive than conventional printing machines.

An essential feature of my invention is a print head that features at least one but more typically several parallel arrays of capillary microchannels that terminate in orifices in a print-head surface that will face the printing substrate. Each microchannel is filled with colored ink up to its respective orifice, where the ink awaits action, being held in the microchannel by capillary action. Ordinarily, the ink's termination surface is concave, and the ink therefore does not mark the printing substrate when the substrate is brought into contact with the print head's face. But since the ink's dielectric constant $\epsilon$ exceeds that of air, an electrode pair placed across each microchannel orifice can generate an electrostatic field that causes the ink to fill that field space and thus become convex, bulging out of the orifice to be available to mark the printing substrate when it comes into contact with the print head's face. Since each microchannel is individually addressable via the electrodes from a print-control circuit, numerous capillaries can be activated in parallel (or in series) to cause line-by-line printing by merely pulsing the ink electrostatically. Accordingly, the print head does not require any moving mechanical parts; instead, it requires appropriate control circuitry for the individual electrodes on the print head.

Because of the ordinarily concave geometry of the ink in the capillary, and because the print substrate can therefore be brought into intimate contact with the print-head surface without making marks in undesired locations, the ink column in any given capillary is required to move only a tiny distance in order to produce a mark on the paper. This means that the entire array can produce color marks in an extremely brief period of time—i.e., arrays of marks can be produced at a high frequency—and the printing machine can therefore achieve high print speed. The print head can readily be provided with a large number of microchannels and associated electrodes so that all pixels in each array can be printed simultaneously when the printing substrate is brought into contact with the print head. In an embodiment in which several arrays are featured in the print head, each array for a different ink color, the printing substrate will, while it advances across the print head, pick up successive ink marks that are superimposed on each other where subtractive color renditions are desired.

Additionally, since the ink merely bulges from the capillary—i.e., it is not propelled like a bullet, as in ink-jet printers, flying through the air at high velocity—the invention can be used on a wide range of print substrates, including plastic films.

In its preferred implementation, this process employs hot-melt ink and thus requires that the print head be heated in order to become functional. When the heated, liquid ink contacts the cool paper, it solidifies in less than one microsecond while it fuses itself to the paper or other print substrate. And when the printing machine is not in use, the microchannels are all solidly plugged up with ink ready to be melted and used within seconds. This feature contributes further to operational robustness.

Another aspect of the invention relates to the flat configuration of the paper transport, with allows it to be very slim. A reciprocating electrostatic advancement gripper is used to move the printing substrate step by step past the print head. The advancement gripper includes electrodes that generate electric fields. These fields draw the printing substrate to the advancement gripper and hold it firmly. Typically positioned by a piezoelectric actuator, the advancement gripper then advances by an incremental distance, and the paper advances with it. The advancement gripper then releases the paper and returns, typically after another, retention gripper has gripped the paper to hold it in place. The advancement gripper then grips the paper again, and, after the retention gripper releases its grip, advances the paper as before.

Such a feed mechanism can be embodied in a very slim package. The grippers can take the form of plates in whose surfaces the electrodes are embedded. And the distance by which the advancement gripper advances is typically so small—one or two times the pixel pitch, which may be, say, 42 $\mu$m for 600 dot-per-inch spacing-that its plate can readily be advanced by a small piezoelectric actuator. So the printer needs only the thickness of these plates and the piezoelectric actuator to accommodate the feed mechanism.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
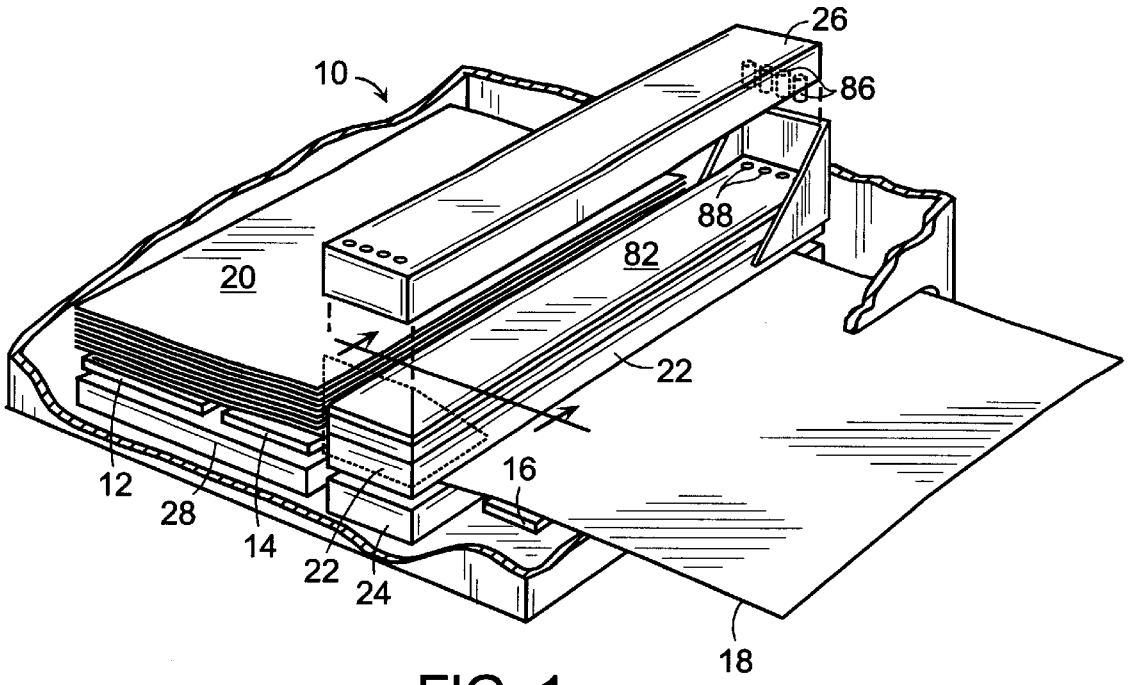
FIG. 1 is a perspective view, partly broken away, of a color printer that employs the present invention's teachings.

FIG. 1 illustrates a printer 10 that employs the present invention's teachings. In a manner that will be described in more detail below, grippers 12, 14, and 16 advance paper 18 from a paper supply 20 past a print head 22. With the aid of a vertically vibrating print plate 24, the print head employs the present invention's teachings to apply an image to the paper by marking it, in its preferred mode, with hot-melt ink from a cartridge 26. 20 To this end, battery-powered circuitry 28 receives image-data signals from a source, not shown, and operates the print head 22 in accordance with the image data thus received. It also operates the gripper plates and vibrating print plate and supplies the power to melt the hot-melt ink in the print head.

Figure 2:
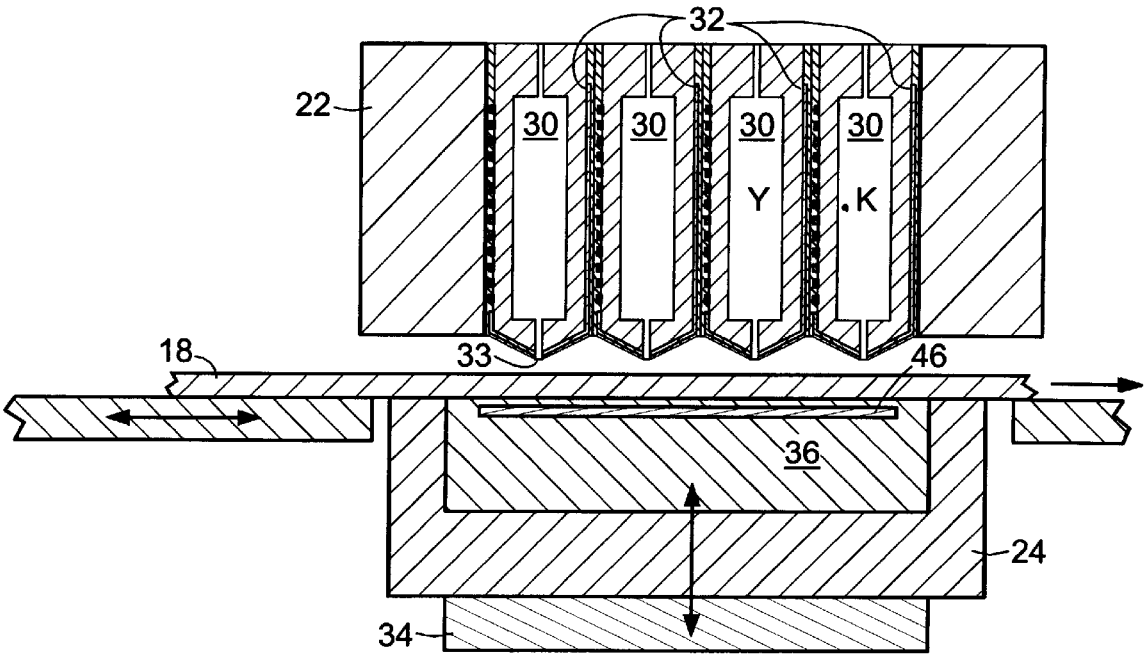
FIG. 2 is a cross-sectional view of the print head taken at lines 2—2 of FIG. 1.

FIG. 2, which is a cross-section taken at lines 2—2 of FIG. 1, partially illustrates the microchannel portion of the print head that performs the marking operation illustrated in FIGS. 3A–E. In a manner that will be described in more detail below, ink-supply channels 30, which extend the full length of the print head 22, are filled with hot-melt ink that NiCr heating elements 32 keep molten. Each of the ink-supply channels feeds an array of, say, 4000 microchannel capillaries 33 along a length of 21 cm from a reservoir at the end of each array.

The illustrated printer is a color printer. It employs the conventional ink-color selection, namely, cyan, magenta, yellow, and black. Although FIG. 2 shows only a single capillary row for each color, more may be provided to speed printing or for other reasons, as will be explained below. None of these features is critical to the present invention.

A piezoelectric actuator 34 causes the print plate 24 to oscillate vertically with a frequency of, say, 2 kHz through a vertical travel on the order of 75 $\mu$m between extended and retracted positions. In its extended position, the print plate's resilient core 36 urges the paper 18 into "kiss" contact, i.e., gentle but uniform contact, with the print head's bottom surface. There the paper is marked by hot-melt ink that selectively applied electric fields have caused to extend as convex protrusions from the orifices of capillaries addressed in a manner that will be described below. The ink movement in and out of the capillary orifice will now be explained by reference to FIGS. 3A–C.

Figure 3C:
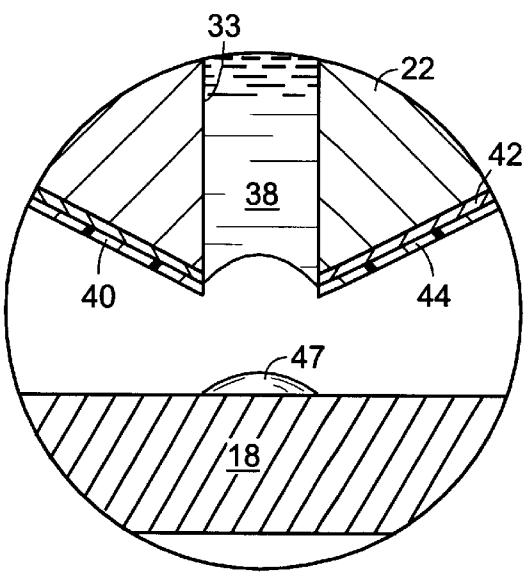
FIGS. 3A–C are more-detailed views of one of the print head's capillary microchannel outlets, illustrating the ink's standby position and the opposing electrodes, which enable the printer to mark the printing substrate.
Figure 3B:
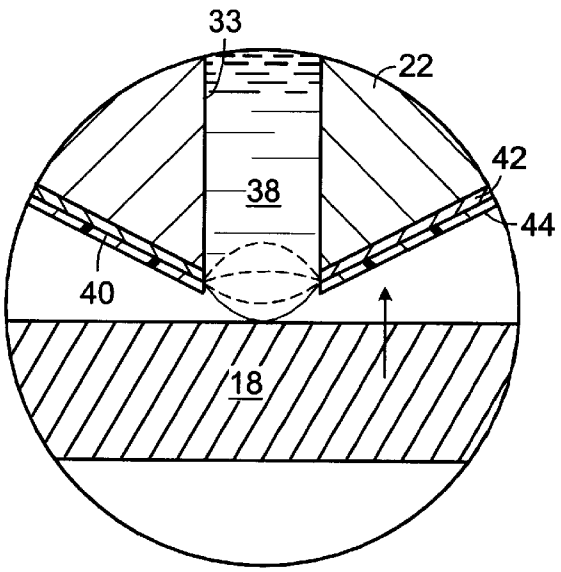
Figure 3A:
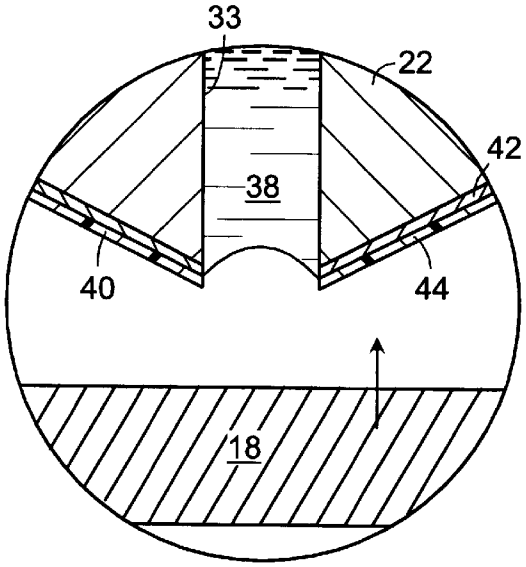
Figure 3D:
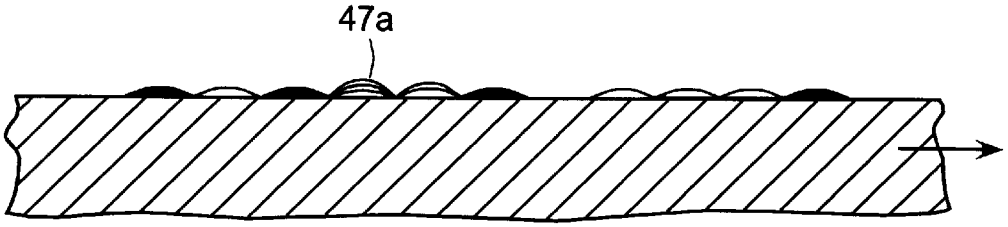
FIGS. 3D–E are respectively cross-sectional and isometric views of the resultant deposited ink dots.

FIG. 3A diagrammatically illustrates a column of ink 38 held by capillary action in one of the capillaries 33. That drawing also shows two electrodes 40 and 42 that are disposed at opposite sides of the capillary orifice. The electrodes are sealed under a Teflon coating 44, which resists wetting by the ink in the capillary. FIG. 3A illustrates the situation in which there is no electrical potential difference between the two electrodes 40 and 42. Surface tension at the orifice causes the ink to assume a concave shape at the orifice and thereby prevents the ink column from marking paper even when the print head is brought into contact with the paper surface.

To cause the ink to mark the paper, the printer applies a voltage of, say, 200 V to electrode 40 while keeping electrode 42 at ground potential. The capillary outlet is on the order of only 40 $\mu$m across, so the applied potential difference causes electric fields on the order of 50,000 V/cm to extend across the capillary orifice. This electrostatic field causes the hot-melt ink, which has been chosen for its high dielectric constant, to respond and move outward into the field domain thus formed and be available for marking the paper when in contact, as FIG. 3B illustrates. An ink suitable for this purpose can be prepared by dispersing fine-particle pigments in a carrier such as Piccotex 75LC hot-melt polymer, available from Hercules Incorporated of Wilmington, Del.

When the hot ink column comes into contact with the (room-temperature) paper, its protruding portion solidifies in less than a microsecond to form a crust on the paper. The printer then removes the electrodes' potential difference, so the (still-liquid) ink column withdraws back into the capillary, as FIG. 3C illustrates. At the same time, the vibrating print plate 24 (FIG. 2) withdraws the paper into its retracted position with the help of a further gripper mechanism 46 embedded in its surface, as will be described in more detail below. This retraction breaks the connection between the crust thus formed and the withdrawing ink column.

Figure 3E:
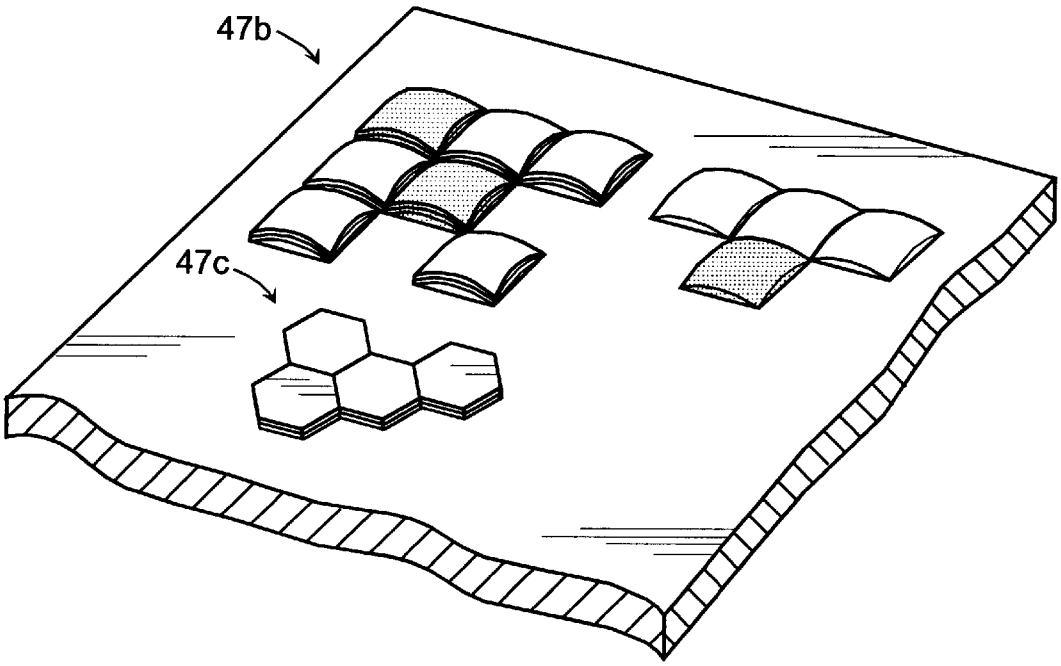

Gripper plates 12, 14, and 16 then advance the paper 18 by the required incremental pixel-pitch distance. In a color version of the invention, the spacing between capillary arrays each containing a different-colored ink is chosen to be an integer number of advancement steps so that a paper location at which a capillary in one row has deposited ink of one color will eventually be positioned in registration with the corresponding capillary in the row that contains the next color. Ink of a different color can therefore be deposited on top of the ink crust 47 that was deposited in the FIG. 3B operation to build up a multi-layer ink-dot deposit such as ink dot 47*a* of FIG. 3D. As will be explained below, the thicknesses of the ink deposits can be controlled, so the various deposited dots occur in varying thicknesses. FIG. 3E depicts the resultant dots as having rectangular shapes 47*b*, which result from a rectangular orifice cross section, but the preferred pixel configuration for this printer is the hexagonal pattern 47*c* that FIG. 3E also illustrates. The cross section of each dot is lenticular, even when it is made of superimposed ink deposits, so the ink dots act as transparent color lenses that facilitate oblique viewing.

Figure 4:
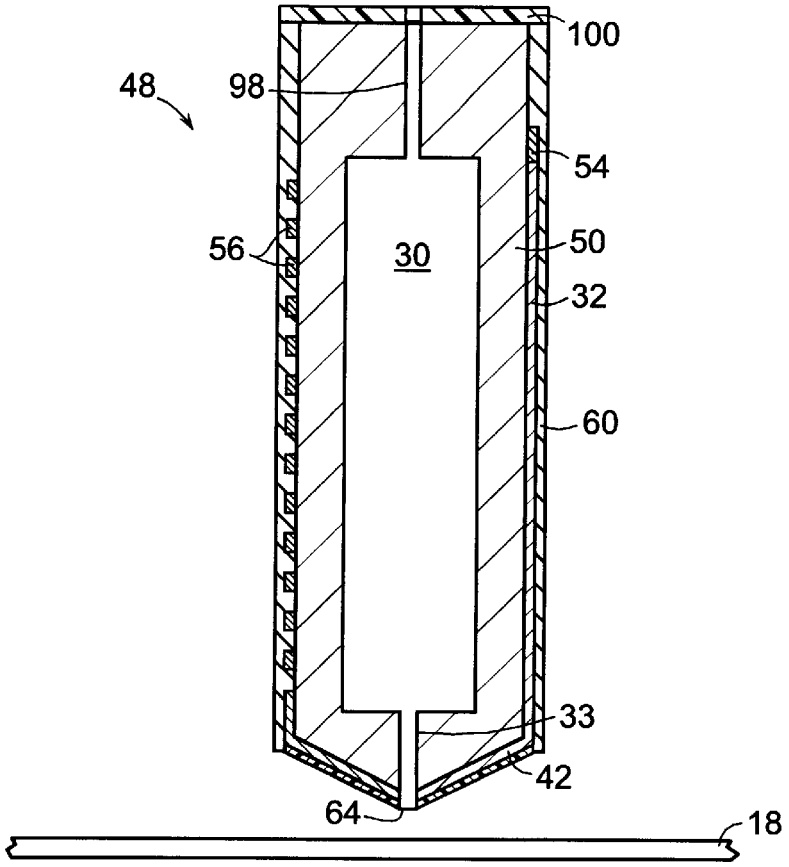
FIG. 4 is a cross-sectional view of one of the multiplicity of print-head modules that make up the print head.

FIG. 4 depicts in more detail a single head module 48, which provides a single array of ink capillary microchannels. The module includes a body 50 of insulating material such as an $Al_2O_3$-powder matrix in which the capillary 33 has been formed by one of the many known microfabrication techniques. A NiCr resistor 32 provided by a flex-print substrate mounted on one side of the head module 48 extends between the grounded electrode 42 and a similarly provided power-supply rail 54. The ink that the head module 48 contains is in solid form when the printer is not in use, but turning the printer on applies electrical power to the resistor 32, which thereupon heats the head module 48 and thus liquefies the hot-melt ink that it contains. The melting process takes about three seconds, after which the printer assumes a ready-to-print state and in some embodiments gives the operator a ready-to-print signal.

Conductors 56 similarly provided by a flex-print substrate mounted on the head module 48's opposite face connect the driven electrode 40 to a printed-circuit-board backplane (not shown) that leads to drive circuits in the printer's circuit module 28 (FIG. 1). Since similar conductors are provided on the corresponding face of an adjacent head module, an insulating layer 60 insulates resistor 32 from the adjacent module's conductors.

Figure 5:
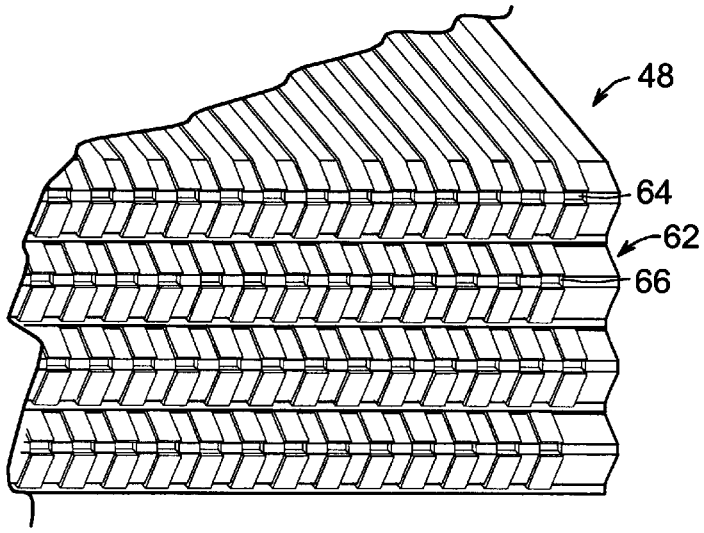
FIG. 5 is an isometric view of the print head, illustrating the individual conductor paths by which control voltages are applied to the electrodes on respective microchannel orifices.

As was previously stated, a printing device that employs the present invention's teachings will typically feature more than one microchannel array for each color. FIG. 5 illustrates such an arrangement, which features two capillary arrays per color in order to interdigitize the print dots. As FIG. 5 shows, the microchannel orifice 64 that module 48 provides are staggered with respect to the adjacent module 62's orifices 66. The purpose of this arrangement is to enhance the printer's spatial resolution. If it proves inconvenient for a single microchannel array to provide the number of orifices per unit array length that the desired image resolution requires, one solution is to use different print-head modules to print different ones of a given row's pixels. For example, if head modules 48 and 62 contain the same ink color and their respective capillaries are staggered as shown, module 48 can deposit, say, the odd-numbered pixels in a given row, and module 62 can deposit the even-numbered pixels in the same row if a time delay that reflects the paper speed is imposed between printing the even-numbered pixels and printing the odd-numbered pixels so as to "stitch together" the interdigitated dots.

Figure 6A:
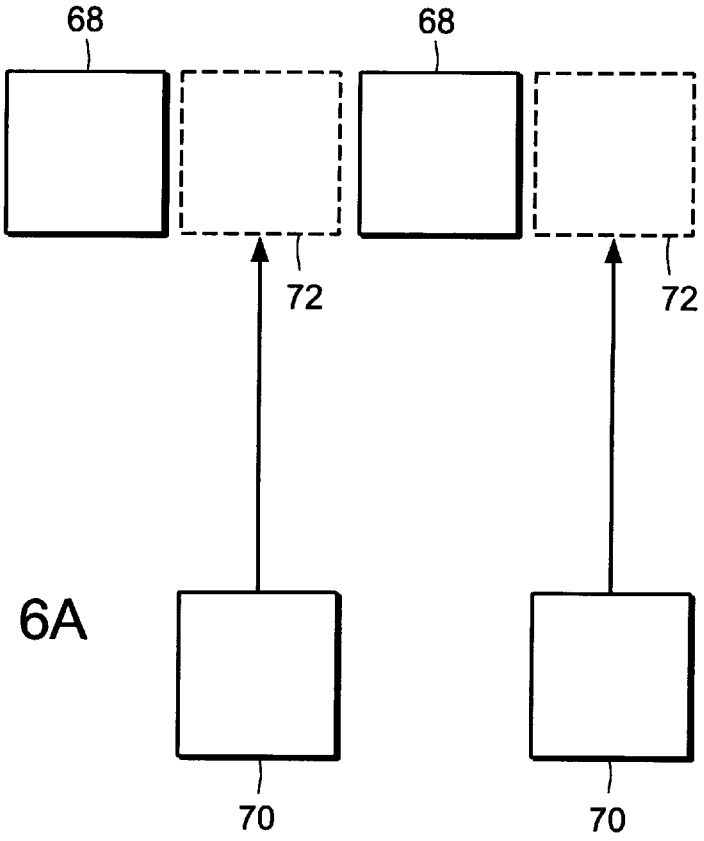
FIGS. 6A and 6B are footprint diagrams that illustrate the cooperation of staggered microchannel arrays to provide a rectangular pixel print geometry.

FIG. 6A illustrates this concept. Let us assume that a given capillary row deposits the nth row of image pixels at time t=n, where time is stated in paper-advancement periods. That is, the paper is advanced at times t=1, 2, . . . Rectangles 68 represent the module-48 orifices' footprints on the paper at time t=n, while rectangles 70 represent the module-62 orifices' footprints on the paper at the same time. If it takes N paper-advancement steps for the row of marks made by module 62 to draw even with the row of module-48 orifices, then rectangles 72 represent the locations at time t=n of the marks that the module-62 orifices made on the paper at time t=n−N. So if module 48's electrodes receive signals for a given image row's odd pixels N paper-advancement steps after module 62's electrodes receive signals for that image row's even pixels, the resultant resolution is twice that achievable by one module only. The resultant pixel arrangement is illustrated in FIG. 6B, in which the module-62 capillaries' marks are labeled A and the module-48 capillaries' marks are labeled B.

Figure 6B:
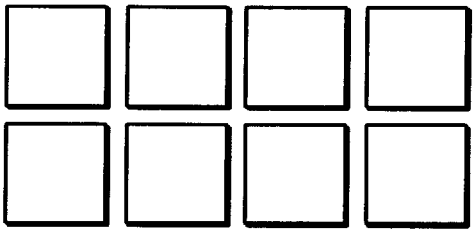
Figure 7A:
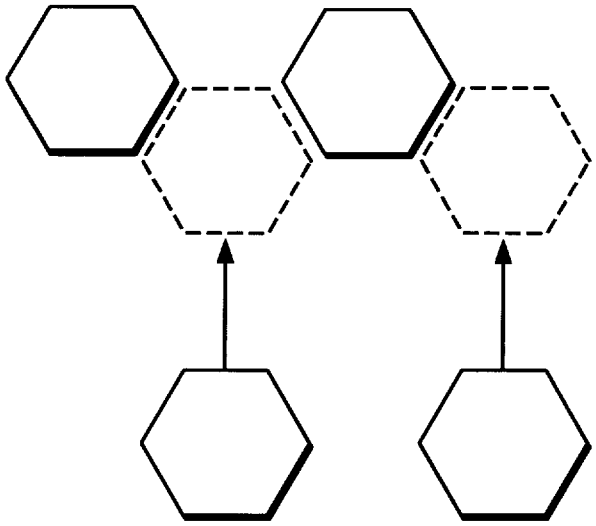
FIGS. 7A and 7B are similar footprint diagrams illustrating the cooperation of staggered microchannel arrays to provide a hexagonal pixel print geometry.
Figure 7B:
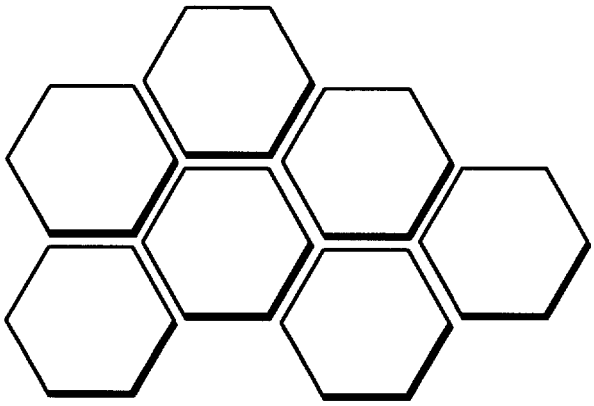

Such a staggered relationship between capillary rows can also be used to achieve a different, hexagonal effect, as FIGS. 7A and 7B illustrate by diagrams respectively corresponding to those of FIGS. 6A and 6B. To achieve the hexagonal effect, not only are the two arrays' footprints staggered "horizontally" (i.e., in the direction transverse to paper advancement), but their respective sequences of row marks on the paper also staggered "vertically" (i.e., in the direction parallel to paper advancement). In such an arrangement, the spacing between adjacent arrays is the product of an odd integer and the distance between printed rows on the paper, and the paper-advancement mechanism advances the paper by two row spacings at a time. Consequently, a given module's array prints all of the pixels in a row, but only on alternate rows.

Figure 8:
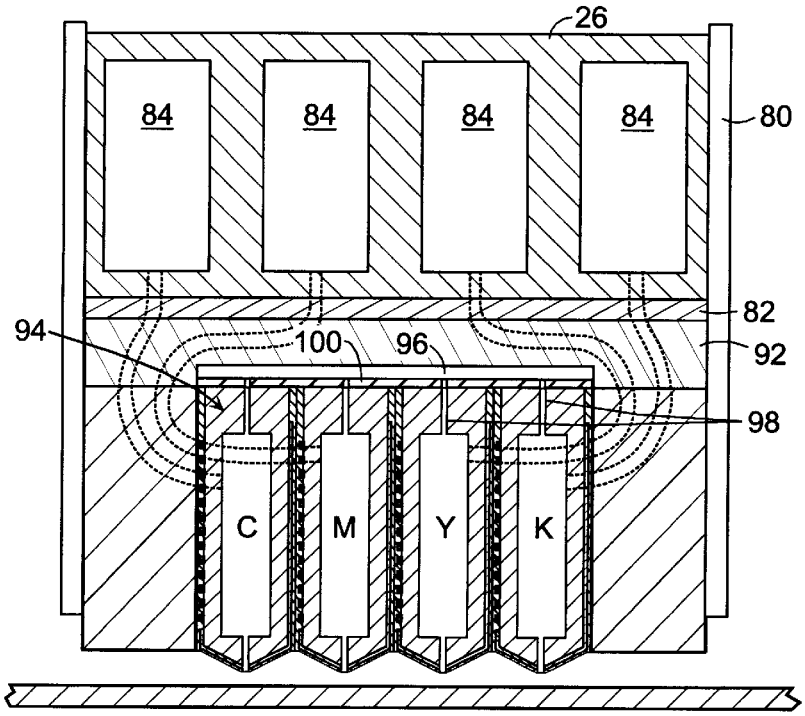
FIG. 8 is a cross-sectional view of the print head illustrating the ink reservoir and supply channels that the printer employs to feed the microchannel capillaries.

In FIGS. 6 and 7, footprints are depicted respectively as rectangular and hexagonal. These shapes reflect the conceptual pixels' shapes, and it may be beneficial for the capillaries' cross sections also to be so shaped. But some embodiments will employ circular capillary cross sections for all pixel arrangements. In each case, the ink deposits have the cross sections of optical lenses placed congruently on top of each other so as to enable viewing from an oblique angle and render the maximum optical effect. Also, although FIGS. 6B and 7B show spaces between adjacent footprints for ease of illustration, it will be appreciated that the actual deposited dots can be so sized as to leave no white space between them. Just as capillary action fills the capillaries with ink, some of this invention's embodiments will also use capillary action to feed ink from the ink cartridge 26 (FIG. 1) to the ink-supply channels 30 (FIG. 2). As FIG. 8 illustrates, the cartridge 26 is snap fit into a receptacle 80 formed on the print head 22. It rests on a heater pad 82, which heats the cartridge 26 and thus the ink in longitudinally extending ink reservoirs 84. These reservoirs communicate at the cartridge rear with respective tubes 86 (FIG. 1), which fit into respective print-head openings 88 that communicate with respective supply channels 30.

Any convenient method may be used to transport the ink from the cartridge to the ink-supply channels. Preferably, however, the conduits are formed by materials that the ink tends to wet and are so sized that capillary action alone will cause the ink to flow like sap in a tree to the supply channels and thereby to the marking capillary microchannels and their orifices.

FIG. 8 also shows that the print head 24 includes a cover 92 that closes a cavity 94 in which the individual head modules are mounted. The cover 92 forms a recess 96 that communicates both with the print-head exterior and with air holes 98 formed at the printhead modules' upper ends to permit air to be displaced as the capillaries' ink columns extend and retract. The print-head modules' upper surfaces may also be provided with a Teflon coating 100 to discourage ink from bleeding through the air vent holes.

Figure 10:
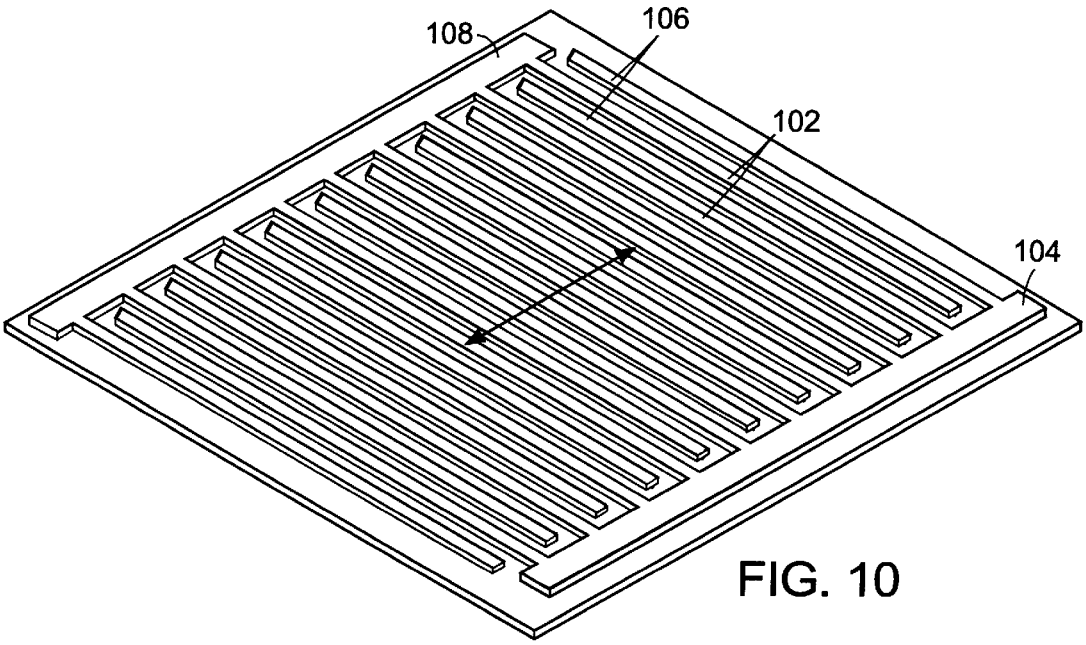
FIG. 10 is an isometric view of a gripper surface illustrating the layout of its electrode fingers as they exist on all four gripper plates.
Figure 9:
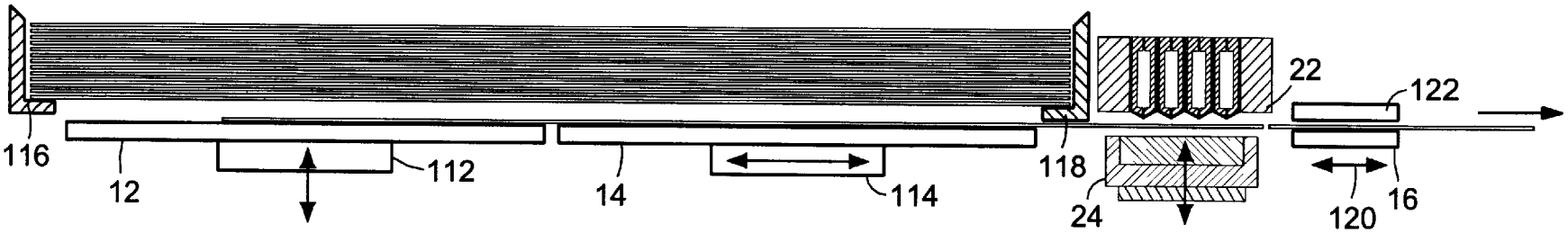
FIG. 9 is a cross-sectional view of the printer showing the printer's dual-plate paper-feed mechanism.

FIG. 9 illustrates the printer's paper-feed mechanism. Embedded in the upper surfaces of gripper plates 12, 14, and 16, as well as print pad 24, which also serves as a gripper plate, are gripper electrodes interdigitated in a manner that FIG. 10 illustrates. A first set of elongated electrodes 102 is connected to a positive-voltage supply pad 104 and interdigitated with a second set of elongated electrodes 106 connected to a negative-voltage supply pad 108. The spacing between adjacent electrodes is on the order of 0.5 mm, so the potential difference between the two supply pads, which is on the order of 200 V when the gripper is activated, sets up an electric field of 4000 V/cm between each pair of adjacent gripper electrodes. The gripper plates thereby draw one paper sheet tightly to themselves. But the first sheet acts to shield all sheets above it, so double feeding never occurs.

When an image is to be printed on anew paper sheet, actuators 112 and 114 advance gripper plates 12 and 14 into engagement with the bottom sheet in the paper supply 20. Those plates' gripper electrodes are energized and thereby draw the bottom sheet 18 to their upper surfaces. Actuators 112 and 114 then retract the gripper plates and thereby pull the bottom sheet past retention lips 116 and 118. The printer then removes power from gripper 12 but not from gripper 14, which therefore retains its hold on the paper.

While gripper 14 retains its hold on the paper, piezoelectric actuator 114 advances gripper plate 14 and thus the paper sheet one advancement step to the right. The advancement step is one pixel-row spacing in the case of the pixel organization of FIGS. 6A and B. In the case of FIGS. 7A and B's pixel spacing, the advancement step is two pixel rows.

Gripper 12's electrodes are then powered again to hold the paper sheet in place, and gripper 14's electrodes release the paper sheet. While gripper 12 holds the paper in place, gripper 14's actuator moves it back to the left, where it again grips the paper. Gripper 12 then releases the paper again, and gripper 14 again advances the paper sheet to the right as before.

This advancing operation feeds the paper sheet into the space between the print head 22 and the print plate 24, which itself has gripper electrodes embedded in its upper surface. The print plate 24's electrodes are energized in synchronism with those of gripper 12 and so timed as to cooperate with the printing process, as FIGS. 11A–D illustrate.

Figures 11A, 11B, 11C, 11D:
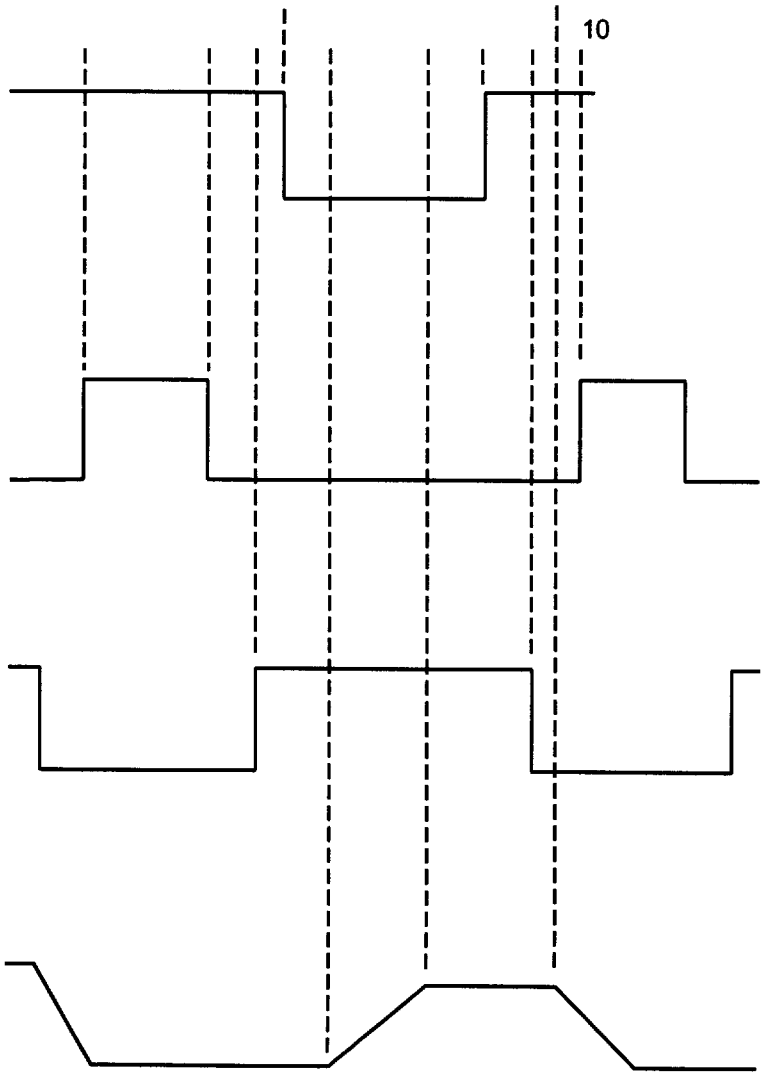
FIGS. 11A–D are timing diagrams that illustrate the paper-feed mechanism's operating sequence.

FIG. 11A represents the energization state of the gripper electrodes on the retention grippers, i.e., the electrodes on gripper plate 12 and print plate 34. FIG. 11B represents the positions of the print plate 24 and the activated microchannels' ink columns. Those drawings show that the ink columns and the print plate 24 assume their advanced positions, in which the ink column can mark the paper, at time $t_1$, while the retention grippers' electrodes are in the energized state. At time $t_2$, the print plate and ink columns retreat to their retracted positions while the print plate's gripper is still energized and thus pulls the deposited ink crust out of contact with the still-liquid ink column. The ink column thereupon snaps back into its respective microchannel and comes to rest at the orifice in a concave position.

The mark thus having been made, it is time for the advancement gripper 14 to grip the paper, and it does so at time $t_3$, as is illustrated by FIG. 11C, which represents the energization state of the advancement gripper's electrodes. The retention grippers then release the paper at time $t_4$ so that the advancement gripper can begin advancing the paper to the right. FIG. 11D, which represents the advancement gripper 14's position, shows that gripper 14 begins that advance at time $t_5$. By time $t_6$, the paper has been advanced to the point where the next marking is to take place, so the retention grippers grasp the paper again at time $t_7$. With the retention grippers thus holding the paper sheet in position, the advancement gripper releases the paper at time $t_8$, and it returns to the left at time $t_9$.

The reciprocation cycle begins again at time, $t_{10}$ and repeats until the entire image has been written on the paper sheet. In the process, the paper sheet advances beyond the reach of the first two gripper plates 12 and 14. To continue the advancement process, a further piezoelectric actuator 120 (FIG. 9) moves advancement gripper plate 16 to the left and right in synchronism with the left-and-right movements of advancement gripper plate 14, its gripper electrodes being energized in synchronism with that plate's. Gripper plate 16 thus cooperates with print plate 24 just as advancement gripper plate 14 cooperates with retention gripper plate 12. But a further retention gripper plate 122 may be added to take over for the print plate 24 in the last stages of the advancement process.

Figure 12:
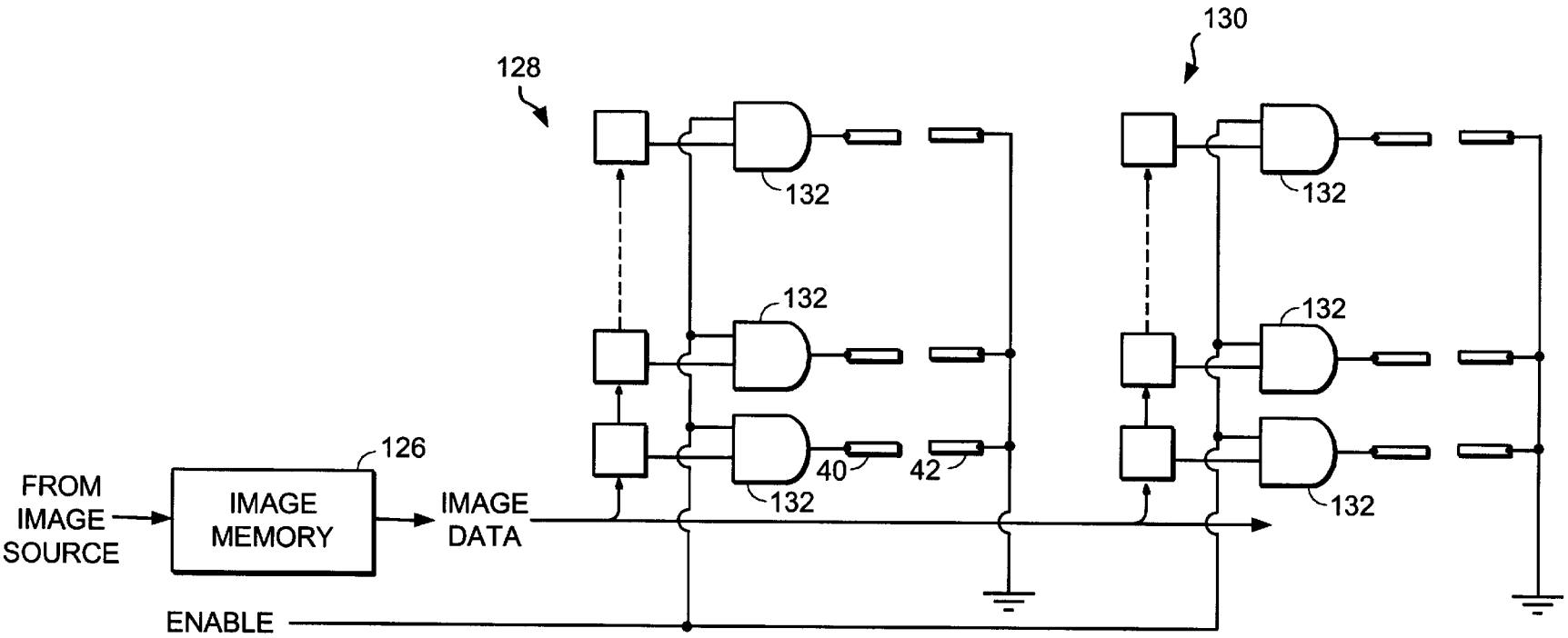
FIG. 12 is a simplified block diagram of microchannel capillary driver circuitry for driving the capillary electrodes in a one-bit-per-pixel version of the present invention.

FIG. 12 is a simplified block diagram that illustrates the data flow employed to drive the print-head electrodes that FIG. 3A's electrodes 40 and 42 exemplify. In a typical arrangement, the electronics module 28 includes a so-called bit-map digital image memory 126, which receives image data from the source of the image to be printed. The source will often be a personal computer or other device that can be supplied with driver software for processing the image data into the form most compatible with the hardware organization described above. Alternatively, the printer can itself be provided with circuitry that performs such processing. In a sophisticated printing device, there will be two DRAM memories, one being loaded while the other is being unloaded into the print-head control circuitry to effectuate the print operation.

Between the times at which the print-head electrodes are energized, one row of image data (or, as was explained above, a subset thereof) is fetched for each microchannel array and supplied to a respective one of several shift registers such as shift registers 128 and 130, which are associated with respective arrays. Each shift register receives its share of the image data for a full row between, say, times $t_2$ and $t_{10}$ of FIGS. 11A–D, and an ENABLE signal gates the shift registers' contents to respective electrode rows, as gates 132 indicate, with the timing that FIG. 11B illustrates. Of course, the FIG. 12 representation is merely conceptual; as was explained above, the voltages applied to the printhead electrodes ordinarily are nearly two orders of magnitude greater than conventional logic levels.

Additionally, FIG. 12 depicts the printer as employing single-bit pixels, whereas the present invention's teachings are readily adapted to multi-bit pixel data. The voltage applied to a capillary's outlet electrodes determines the distance by which the ink column protrudes from it. That distance, in turn, determines the size of the resultant printed dot and thus the darkness of a region marked with such dots. So multi-bit pixel data representing color darkness can specify which of a set of predetermined voltages to apply to a given capillary's electrodes in order to achieve that darkness. To that end, a printer that employs the present invention's teachings in a multi-bit embodiment may use an arrangement such as that of FIG. 13.

Figure 13:
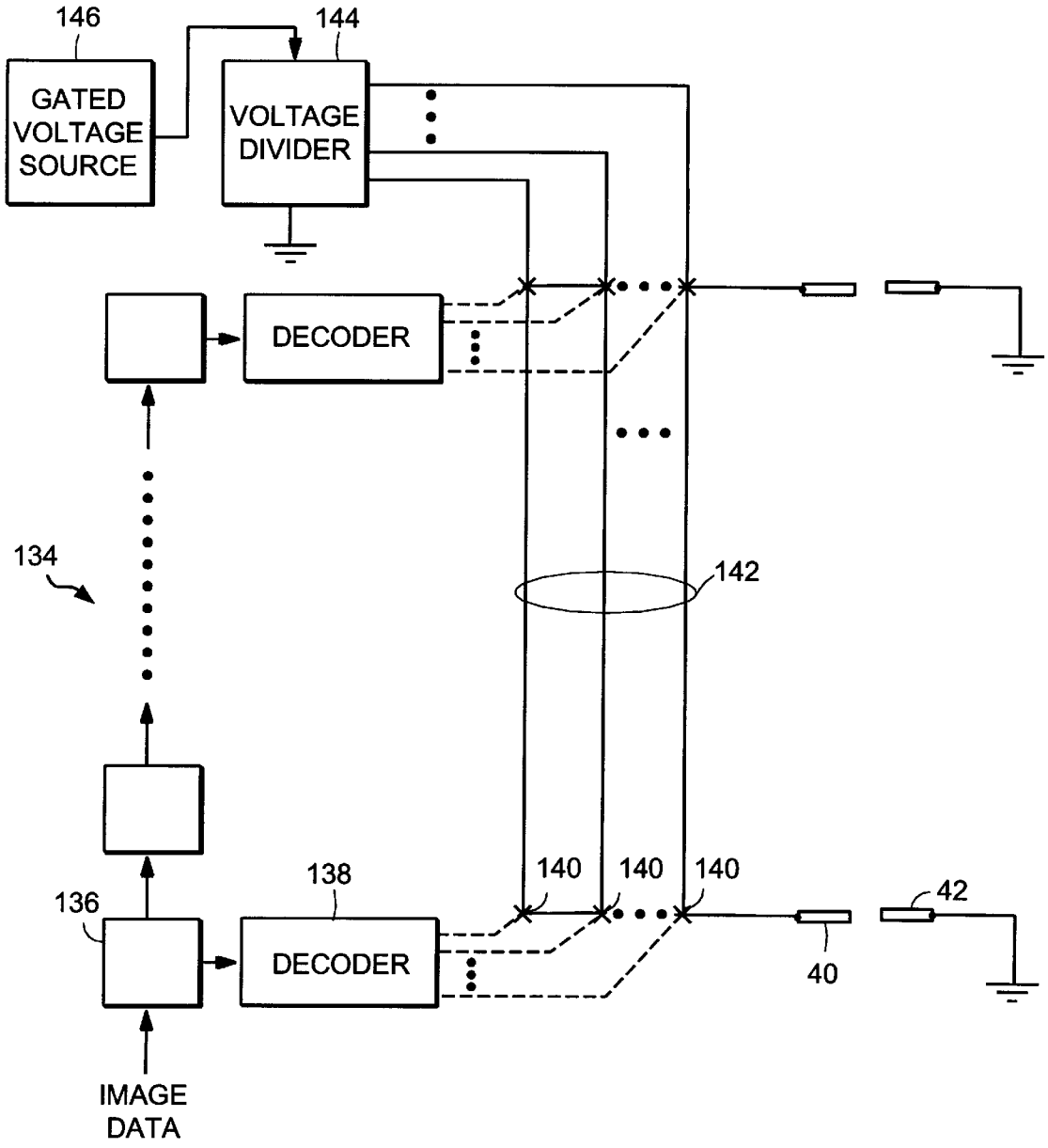
FIG. 13 is a simplified block diagram of capillary-driver circuitry for driving the microchannel capillary electrodes in a multi-bit-per-pixel version of the present invention.

FIG. 13 shows a shift register 134 that contains image data for a single one of a plurality of microchannel arrays. One of its stages 136 may contain the data used to specify the voltage to the applied to electrode 40. Stage 136's contents may be, say, a four-bit number, which a decoder 138 uses to select among sixteen electronic switches 140 by which electrode 40 can be connected to a selected line of an electrode-voltage bus 142. The voltages on these lines are respective tap outputs of a voltage divider 144 whose input is the output of a gated voltage source 146. Source 146's output is a repetitive pulse whose timing FIG. 11B depicts and whose amplitude at least equals the voltage corresponding to the digital image data's full-range value. So the digital contents of a shift-register stage select the size of the ink dot that the corresponding capillary will deposit when the desired image-medium location is properly positioned adjacent to the respective capillary's outlet.

It is thus apparent that a printer embodying the present invention's teachings can be exceedingly simple and robust mechanically. The print head is a simple manifold structure that has no moving parts. Ink application is controlled by arrays of electrodes, which can be provided on a simple flex-print substrate. Such a printer is well suited to use with hot-melt inks, so its performance is not sensitive to the type of paper being used—and it contains no liquid ink when it is not in use. Moreover, the use of reciprocating electrostatic grippers greatly contributes to the compactness of the resultant printer package; since their travel is microscopic, a full-color printer can be made that is only slightly larger than the paper supply that it includes. The present invention thus constitutes a significant advance in the art.

What is claimed is:

1. For placing visual marks on a printing substrate with a printing apparatus comprising:

A) a print head featuring at least one or more microchannels that fill themselves through capillary action fully to their orifices with printing ink which has a dielectric constant greater than air;

B) a positioning mechanism that places the printing substrate in close proximity and in juxtaposition to the microchannel orifices with said mechanism having the ability to kiss-contact all the orifices; and C) an electronic driver circuit which operates in response to image-data signals from a bit-map electronic memory so as to impose selectively electrical fields across each addressed microchannel orifice in accordance with stored or received image data with said electronic field being of variable field strength and shape according to said image data to cause said printing ink to protrude from said orifices in convex shape in conformance with the field strength and shape of each field on each orifice so as to be contactable with said printing substrate for the purpose of transferring the protruding portion of said ink to said substrate and split the ink upon withdrawing the printing substrate from said orifices.

2. An apparatus as defined in claim 1 wherein the positioning mechanism includes a perpendicular reciprocating mechanism that moves the printing substrate alternately into kiss-contact position with the orifices, and into a retracted position in which it maintains a sufficient distance from said orifices so as to allow the advancement of the printing substrate without contacting the ink.

3. An apparatus as defined in claim 2 further including an electrostatic, reciprocating advancement mechanism for the printing substrate, which advances said substrate transversely with respect to the microchannel orifice locations.

4. A printing apparatus as defined in claim 3 wherein the printing substrate advancement mechanism advances the printing substrate only while the printing substrate is in the retracted position.

5. A printing apparatus as defined in claim 2 wherein:

A) the microchannel driver circuit operates either simultaneously or serially for all addressed microchannels in:

i) a marking mode, in which it imposes the electrical field in variable strength across each microchannel orifice in accordance with the image data before and during contact with the printing substrate; and ii) a non-marking mode, in which no electrical field is imposed across the orifice so as to rely on the capillary action solely to keep the ink in concave shape as the orifice waiting to be activated;

B) the vertical reciprocating mechanism places the printing substrate in the elevated kiss-contact position when the microchannel driver operates in the marking mode while some microchannels are in the non-marking mode; and C) the reciprocating mechanism places the image medium in the retracted position when the mechanism is operating in the printing substrate advance mode.

6. An apparatus as defined in claim 2 wherein the reciprocating mechanism comprises a unidirectional piezoelectric actuator.

7. A printing apparatus as defined in claim 1 wherein:

A) the print head features several parallel dual arrays of microchannels across the width of the printing plane with each dual array being connected to an internal, common ink supply space of dedicated color keeping all the microchannels filled with liquid ink due to capillary action keeping the ink in "ready-to-print" position;

B) a printing substrate transport mechanism moves said substrate in step-wise advances under the print head orifices in perpendicular direction to the arrays of orifices and a vertical elevating, reciprocating mechanism can achieve kiss contact with the print head orifices; and C) the capillary driver circuit selectively imposes respective electrical fields of varying strength across the addressed orifices in accordance with image data that the image-data signals associate with respective print row positions, so as to create electrical fields that force ink from the addressed orifices to protrude in convex shape to be ready to mark the printing substrate once it is brought into kiss-contact with the orifices of the print head.

8. A printing apparatus as defined in claim 7 wherein:

A) each ink supply space feeds a dual array of microchannels to fill them with ink by capillary action;

B) a printing-substrate forward stepping transport and reciprocating elevation mechanism that places said substrate into juxtaposition with the print head ready to make kiss-contact with all the microchannels at once thereby simultaneously picking up all the ink that protrudes from the microchannels; and C) the driver circuit selectively imposes respective varying electrical fields across the addressed orifices of the microchannels which present themselves as parallel dual arrays of different colors that, with the aid of the transport mechanism and its contactability, can be superimposed on each other to produce many hues and saturations of different colors.

9. A printing apparatus as defined in claim 8 wherein:

A) the apparatus further includes a printing substrate advancement mechanism, which advances the printing medium in perpendicular direction with respect to the microchannel outlets; and B) the arrays of microchannels are organized into pairs of rows thereof, the orifices of each pair being laterally offset in an interdigitated manner in the medium-advancement direction.

10. A printing apparatus as defined in claim 7 further including an ink heater in the print head to liquefy solid hot melt ink thereby filling all microchannels with hot, liquid ink.

11. A printing apparatus as defined in claim 1 wherein the apparatus further includes a printing substrate advancement mechanism, which advances step by step the printing substrate with respect to the orifices of the print head, said mechanism comprising:

A) an advancement gripper plate that alternately grips and releases the print ing substrate; and B) an advancement actuator that accurately advances the advancement gripper plate in the substrate advancement direction while the advancement gripper plate grips the printing substrate and withdraws the advancement gripper plate in the opposite direction when the advancement gripper plate has released said substrate.

12. A printing apparatus as defined in claim 11 wherein the advancement gripper plate grips the printing substrate by generating electrostatic fields that attract the printing substrate to the advancement gripper plate mechanism and then releases the substrate once attached to said plate by reducing the strength of the electrostatic fields that the advancement gripper emanates.

13. A printing apparatus as defined in claim 12 wherein:

A) the apparatus further includes a retention gripper plate that alternately grips and releases the printing substrate;

B) the advancement actuator advances the advancement gripper plate in step and repeat fashion in the substrate advance direction after the retention gripper plate has released the printing substrate; and C) the advancement actuator withdraws the advancement gripper plate in the opposite direction while the retention gripper plate grips the printing substrate and holds it in its newly arrived position.

14. An apparatus as defined in claim 13 wherein the retention gripper plate grips the printing substrate by generating electrostatic fields that attract the substrate to the retention gripper plate mechanism and releases the printing substrate by reducing the strength of the electric fields that the retention gripper generates.

15. A printing apparatus as defined in claim 11 wherein the advancement actuator comprises a piezoelectric actuator that propels the gripper plate in a reciprocating fashion.

16. A printing apparatus as defined in claim 1 further including an ink heater.

17. For marking on a printing substrate, an apparatus comprising:

A) a print head capable of marking a printing substrate by selectively causing the convex protrusion of a color liquid ink that is characterized by having a high dielectric constant thus being able to move dielectrophoretically in response to a momentarily applied electrical field at selective orifices of the print head and transferring said ink upon content with the printing substrate; and B) a substrate-advancement mechanism, which advances, the substrate to the print head's marking plane and beyond in stepwise fashion to pick up ink marks through momentary contact with the orifices of the print head with the said apparatus including:

i) an advancement gripper plate that alternately grips and releases the printing substrate; and ii) an advancement actuator that advances the advancement gripper plate in the substrate-advancement direction while the advancement gripper plate grips the printing substrate and withdraws the advancement gripper plate in the opposite direction when the advancement gripper plate has released the image medium.

18. An apparatus as defined in claim 17 wherein the advancement gripper plate grips the printing substrate by generating electrostatic fields that attract the substrate to the advancement gripper plate mechanism and releases the substrate by reducing the strength of the electric fields that the advancement gripper emanates.

19. A printing apparatus as defined in claim 18 wherein:

A) the apparatus further includes a retention gripper plate that alternately grips and releases the printing substrate;

B) the advancement actuator advances the advancement gripper plate in the substrate-advancement direction when the retention gripper has released said substrate; and C) the advancement actuator withdraws the advancement gripper plate in the opposite direction while the retention gripper plate grips said printing medium.

20. A printing apparatus as defined in claim 19 wherein the retention gripper plate grips the image medium by generating electric field that attracts the printing substrate to the retention gripper plate mechanism and releases said substrate by reducing the strength of the electric fields that the retention gripper plate generates.

21. An apparatus as defined in claim 17 wherein the advancement actuator comprises a piezoelectric actuator that is capable of propelling the gripper plate in a reciprocating stepwise fashion.

22. For producing color marks on a printing substrate, a method comprising the steps of:

A) providing a print head that features arrays of microchannels with their orifices being positioned in juxtaposition to the printing medium a very short distance away so as not yet to touch B) filling the microchannels via capillary action all the way to the orifices of said microchannels with liquid color ink whose dielectric constant $\epsilon$ is many times greater than air with said ink waiting in concave position at said orifices until activated; and C) activating the ink by imposing an electrical field of variable intensity across each orifice so as to create by dielectrophoresis a movement of the ink out of the addressed microchannels to cause the field intensity proportional protrusion in convex shape of the ink whereupon it can be brought in kiss-contact with the printing substrate surface.

23. A color marking method as defined in claim 22 wherein:

A) the ink is a solid at room temperature; and

B) the method further includes:

i) so heating the ink as to melt it into a state of low viscosity;

ii) keeping the ink molten while imposing the electrical field across the microchannel orifice; and iii) re-solidifying the ink upon contact with the room temperature printing substrate.

24. A marking method as defined in claim 22 wherein:

A) the printing substrate is a sheet material; and

B) the method further comprises the steps of:

i) repeatedly employing an advancement gripper plate to alternately grip and release the same sheet of the printing substrate while it advances;

ii) repeatedly advancing the advancement gripper plate in a the printing direction while the advancement gripper plate grips the same sheet of the printing substrate and withdrawing the advancement gripper plate in the opposite direction while the substrate sheet is released from the advancement gripper plate; and iii) repeatedly performing the step of imposing electrical fields across each addressed orifice of the print head to cause convex ink protrusions in an imagewise pattern from the arrays of orifices of the print head; and iv) fetching the ink from said orifices by elevating the printing substrate to the print head surface where it kiss-contacts the ink protrusion to effectuate the marking of the substrate surface.

25. A substrate transport method as defined in claim 24 wherein the step of repeatedly employing the advancement gripper plate to alternately grip and release the same sheet of the printing substrate which comprises gripping the printing substrate by generating electric fields that attract the said substrate to the advancement gripper plate and releasing the printing medium by reducing the strength of the generated electric fields while also causing the momentary elevation of the printing substrate to the print head surface and gently contacting it along the full length of the print head.

26. A substrate transport method as defined in claim 25 further comprising:

A) repeatedly employing a retention gripper plate alternately to grip and release the same substrate sheet of the image medium; and B) performing the step of repeatedly advancing the advancement gripper plate while the substrate is released by the retention gripper plate and performing the step of repeatedly withdrawing the advancement gripper plate while the retention gripper grips momentarily the printing substrate.

27. A substrate transport method as defined in claim 26 wherein the step of repeatedly employing the retention gripper plate to alternately grip and release the same sheet of the printing substrate comprises gripping said substrate by generating electrostatic fields that attract the printing substrate to the retention gripper plate and releasing it by reducing the strength of the electric fields that the advancement gripper plate generates.

28. A substrate transport method as defined in claim 24 further comprising:

A) repeatedly employing a retention gripper plate alternately to grip and release the same sheet of the printing substrate; and B) performing the step of repeatedly advancing the advancement gripper plate while said substrate is released by the retention gripper plate and performing the step of repeatedly withdrawing the advancement gripper plate while the retention gripper plate grips the printing substrate.

29. For producing imagewise color marks on a printing substrate consisting of sheet material, a printing method comprising the steps of:

A) providing a print head capable of marking an imaging substrate surface with color ink and placing said print head in closely spaced juxtaposition to said substrate surface;

B) repeatedly employing an advancement gripper plate to alternately grip and release the same sheet of the image medium while it is located under the print head's printing plane and then elevating after each advancement step the substrate to kiss-contact the print head surface;

C) repeatedly advancing the advancement gripper plate in a substrate-advancement direction while the advancement gripper plate grips the same sheet of the image medium and withdrawing the advancement gripper plate in the opposite direction while the sheet is released from the advancement gripper;

D) repeatedly operating the print head in accordance with signals from the image memory and control circuit to mark the sheet between each advancement of the advancement gripper plate;

E) causing the marking of the substrate by elevating it to contact the print head along its full length and width.

30. A color marking and substrate transport method as defined in claim 29 wherein the step of repeatedly employing the advancement gripper plate to alternately grip and release the same sheet of the printing substrate comprises gripping the image substrate by generating electrostatic fields that attract the substrate to the advancement gripper plate and releasing said substrate by reducing the strength of the electric fields that the advancement gripper generates.

31. A substrate transport method as defined in claim 30 further comprising:

A) repeatedly employing a retention gripper plate to alternately grip and release the same sheet of the printing substrate; and B) performing the step of repeatedly advancing the advancement gripper plate while the printing substrate is released by the retention gripper plate and performing the step of repeatedly withdrawing the advancement gripper plate while the retention gripper plate grips the printing substrate.

32. A substrate transport method as defined in claim 31 wherein the step of repeatedly employing the retention gripper plate to alternately grip and release the same sheet of the image medium comprises gripping the image medium by generating electrostatic fields that attract the printing substrate to the retention gripper plate and releasing said substrate by reducing the strength of the electric fields generated to attract said substrate to the retention gripper plate.

33. A substrate transport method as defined in claim 29 further comprising:

A) repeatedly employing a retention gripper plate to alternately grip and release the same sheet of the image medium; and B) performing the step of repeatedly advancing the advancement gripper plate while said substrate is released by the retention gripper plate and performing the step of repeatedly withdrawing the advancement gripper plate while the retention gripper grips the image medium.

34. A method of placing marks that consist, at the time of marking, of a dielectric liquid medium that is placed onto a printing substrate surface in conformance with electrical signals arriving in a digital data stream, comprising the steps of:

A) holding the liquid medium in flat or concave shape at the orifices of one or more arrays of capillary-fed, ink-containing microchannels;

B) pulsing the ink forward dielectrophoretically to extend above individually addressed orifices and adopt a protruding convex shape at each electrically addressed orifice in the array, with the amount of ink that protrudes from any addressed orifice being proportional to the electrical field strength and spatial shape of said field that is imposed across any individual orifice of said array;

C) first holding the printing substrate being in juxtaposition but close proximity to all the orifices, and then elevating the substrate to momentarily establish kiss-contact with all the orifices, thereby picking up all the protruding convex ink portions but none of the ink held in flat or concave shape inside the microchannels, with the printing substrate then being withdrawn, thus creating an imagewise pattern of printed dots on said substrate as the substrate advances step by step in perpendicular direction to the transverse array to fill the substrate surface with the equivalent pattern information held in a digital memory or being conveyed by the signals of the arriving data stream, thereby creating, through successive ink dot imposition, a superior image topography consisting of lenticular superimposed ink deposits.

35. An image topography produced by the printing method of claim 34 that features a variety of pixel footprints such as rectangular, round, or hexagonal shapes fitting seamlessly together so as not to leave unprinted space between pixels, but whose cross section is lenticular so as to form lens-like compilations of ink on top of each other when superimposed as layers of various colors to produce a composite color effect characterized by allowing viewing the printed images from various angles without causing the usual visual information loss.

* * * * *